United States Patent [19]

Namiki et al.

[11] 4,152,888

[45] May 8, 1979

[54] ELECTRONIC WRIST WATCH

[75] Inventors: Ryo Namiki; Kenzi Miyasaka, both of Tokyo, Japan

[73] Assignee: Citizen Watch Co., Ltd., Tokyo, Japan

[21] Appl. No.: 875,757

[22] Filed: Feb. 7, 1978

Related U.S. Application Data

[63] Continuation of Ser. No. 755,807, Dec. 30, 1976, abandoned.

[30] Foreign Application Priority Data

Jan. 8, 1976 [JP] Japan ..... 51-849
Jan. 9, 1976 [JP] Japan ..... 51-1873

[51] Int. Cl.[2] ..... G04B 19/24

[52] U.S. Cl. ..... 58/58; 58/23 R; 58/23 BA; 58/4 A; 58/85.5

[58] Field of Search ..... 58/23 R, 23 BA, 4 A, 58/58, 85.5, 59, 7, 57

[56] References Cited

U.S. PATENT DOCUMENTS

| | | | |
|---|---|---|---|
| 2,985,705 | 5/1961 | Smythe | 58/23 BA X |
| 3,439,493 | 4/1969 | Mutter et al. | 58/58 |
| 3,555,811 | 1/1971 | Von Zeppelin et al. | 58/58 X |
| 3,645,086 | 2/1972 | Niznik | 58/58 X |
| 3,983,691 | 10/1976 | Schaller et al. | 58/58 X |

*Primary Examiner*—Ulysses Weldon
*Attorney, Agent, or Firm*—Sherman & Shalloway

[57] ABSTRACT

In an electronic wrist watch various component parts are disposed on a plurality of superposed substrates and at least one substrate is provided with a recess or notch for accommodating a battery. A calendar correction mechanism is provided near the stem of the watch and the calendar display mechanism is located opposite the stem.

3 Claims, 5 Drawing Figures

ELECTRONIC WRIST WATCH

This is a continuation, of application Ser. No. 755,807, filed Dec. 30, 1976 now abandoned.

BACKGROUND OF THE INVENTION

This invention relates to an electronic wrist watch and more particularly to an improved feeding and correcting mechanism for a calendar incorporated into the wrist watch.

A recent trend in the wrist watch art is to decrease its size and thickness. In a wrist driven by a mechanical drive source, this object has generally been accomplished. However, in electronic wrist watches of the escapement type, tuning fork type and quartz type, especially of the type in which the time is displayed by hands, the size of the battery, oscillator and circuit elements makes it difficult to miniaturize the watch. The problem of reducing the size of the oscillator and circuit elements has already been solved by the advance of the art, and the effect of the thickness of the battery has also been alleviated by providing a recess or perforation through a base plate. However, where it is desired to incorporate a calendar feed mechanism and its correction mechanism into an ordinary wrist watch sufficient space is not available.

SUMMARY OF THE INVENTION

It is an object of this invention to provide an improved electronic wrist watch having an improved construction suitable for incorporating a calendar and a calendar correction mechanism and which can be formed thin.

Another object of this invention is to provide an improved electronic wrist watch requiring a small member of component parts and which is easy to assemble.

According to this invention, there is provided an electronic wrist watch comprising a plurality of superposed substrates: component parts of the wrist watch are disposed on the substrates: a battery accommodating means is provided for at least one substrate: a calendar correcting mechanism drawings disposed near a stem of the watch, and a calendar display mechanism positioned opposite the stem.

DESCRIPTION OF THE PREFERRED EMBODIMENT

Figure 1:
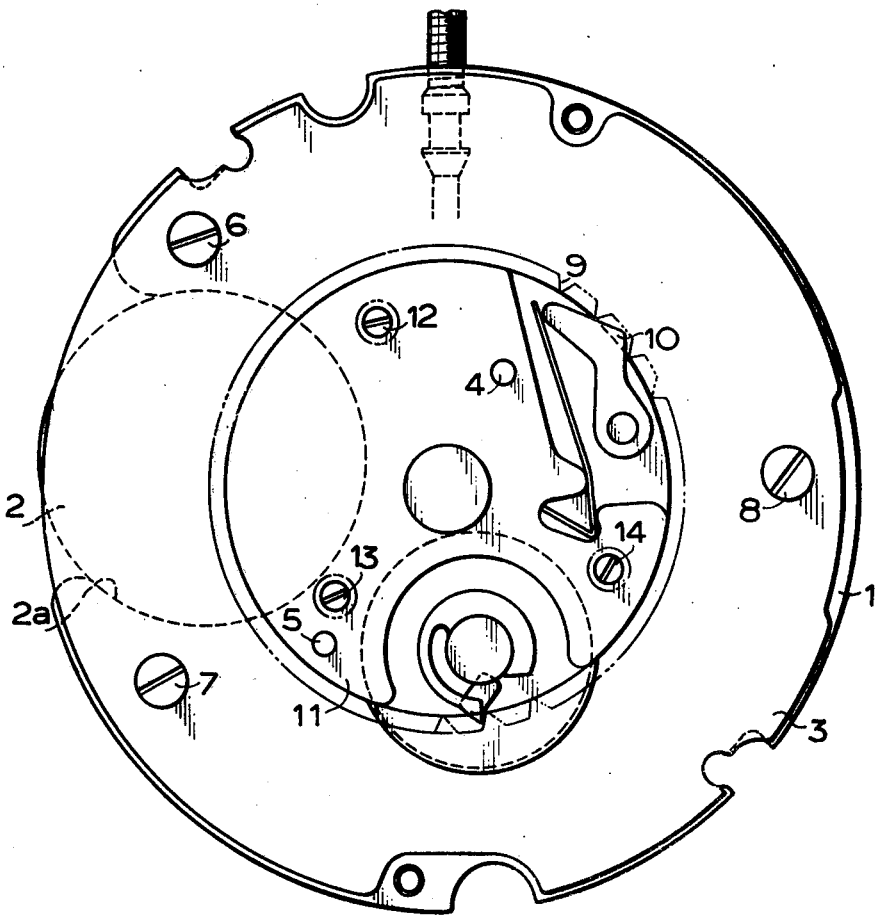
FIG. 1 shows a plan view of an assembly comprising a base plate, a date dial and a rear plate.

Referring first to FIG. 1 of the accompanying drawing a base plate 1 is provided with a notch or recess *2a* adapted to receive a battery 2. A rear plate 3 is secured to the base plate 1 by screws 6, 7 and 8. The correct position of the rear plate 3 is ensured by pins 4 and 5 secured to the base plate 1. A calendar is constituted by a date dial 9, a daily jumper 10 for controlling the position of the date dial 9 and a guide plate 11 for guiding the date dial 9. The guide plate 11 is urged to the rear plate 3 by screws 12, 13 and 14 which extend through the guide plate 11 and the rear plate 3 and threaded into the base plate 1 as will be described later in more detail. Accordingly, the battery 2 is supported directly by the rear plate 3 which is reinforced by the guide plate 11. Screws 6, 7, 12 and 13 are located close to the battery 2 so as to prevent interruption of the circuit connection which occurs when the rear plate 3 and the guide plate 11 are deformed by a shock applied to the battery.

With this construction, since the guide plate supports the battery, it is possible to efficiently support the battery without increasing the number of the component parts, and without increasing the thickness of the watch. It is also possible to eliminate a partial portion cut of circular shape for the sliding portion of the date dial thereby decreasing the manufacturing cost of the wrist watch.

Figure 2:
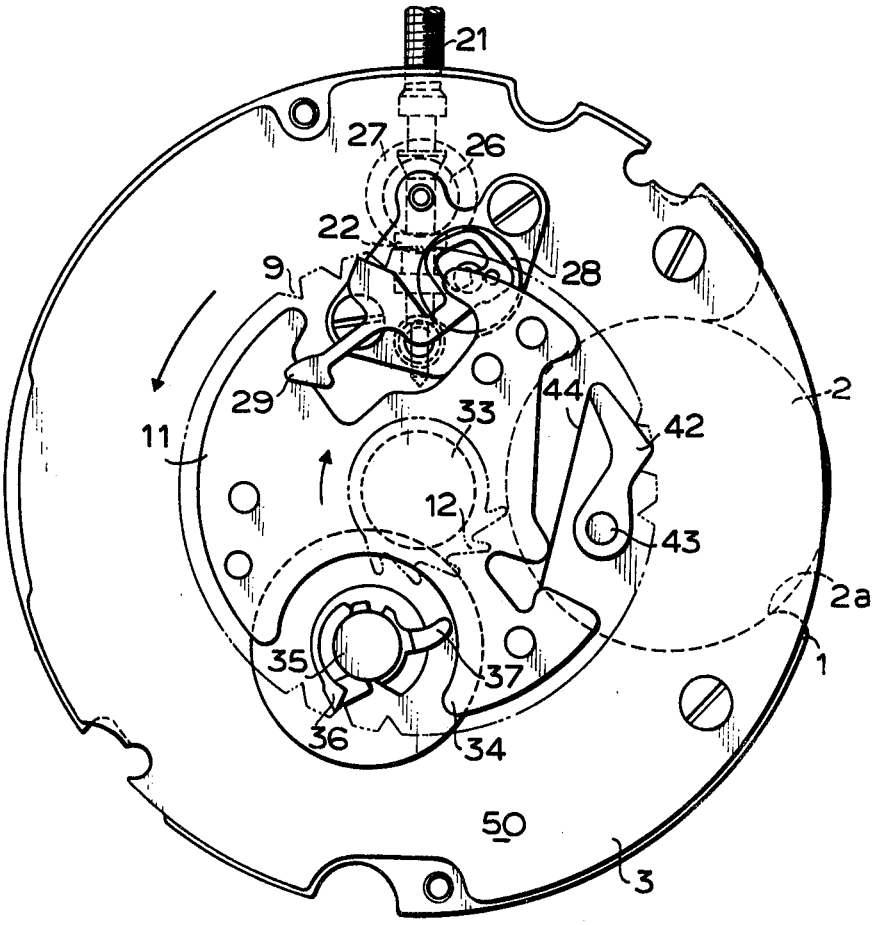
FIG. 2 is a plan view similar to FIG. 1 but also showing calendar operating mechanism and a calendar correcting mechanism.
Figure 4:
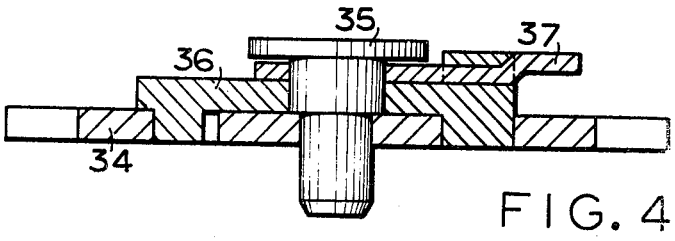
FIGS. 3, 4 and 5 are sectional views showing certain portions of the mechanism shown in FIG. 2.
Figure 3:
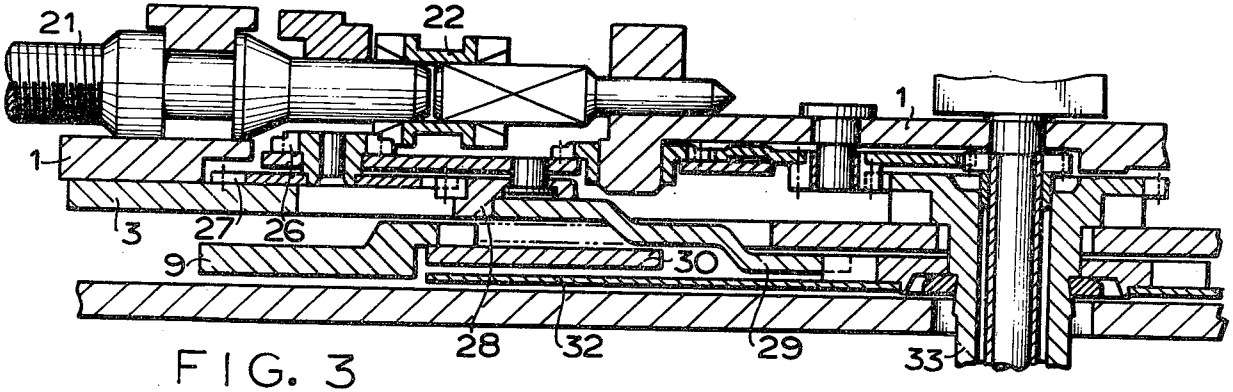

Turning now to FIGS. 2 to 4 the calendar operating mechanism and the calendar correcting mechanism are located near a stem 21 of the wrist watch and the rotation of the stem is transmitted through a globoidal gear 22. A gear 26 which is rotatably mounted on the base plate 1, a gear 27 integral with gear 26 and a correction gear 28 so as to swing a correction lever 29 which is fitted on a projection on the correction gear 28 thereby correcting the display of date dial 9 and a week day dial 32.

Figure 5:
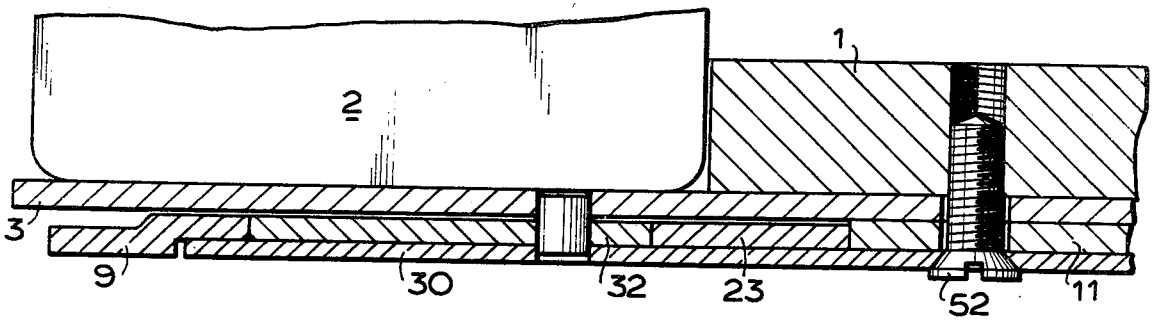

As shown in FIGS. 2 and 4, a display feed gear mechanism 50 is constituted by a gear 33 disposed at the center of the watch, a display feed gear 34 directly meshing gear 33, a date feed pawl 36 secured to a shaft 35, and a week day feed pawl 37 superposed on the date feed pawl 36 and actuated by the projection thereof. As shown in FIG. 2, the display feed gear mechanism 50 is disposed in a recess formed in the base plate 1 on the side opposite the stem 21 and covered by the rear plate 3. The date dial 9 is positioned above the rear plate 3, and the diametrical position of the date dial 9 is controlled by the guide plate 11. A clamping plate 30 provided with the daily jumper 10 for controlling the display position of a week day dial 31 is secured to the base plate 1 by a screw 52 together with the rear plate 3 and the guide plate 11. A control member 42 for controlling the date display position is pivotally mounted on a pin 43 secured to the rear plate 3 which covers the recess or notch *2a* of the base plate 1. The control member 42 is biased by the resiliency of a leaf spring 44 secured to the date dial guide plate 11 for positioning the date dial 9 to a predetermined position. The control member 42 is clamped between the rear plate 3 and the date dial clamping plate 30 as shown in FIG. 5.

As above described the date display control member is disposed on the rear plate 3 at a position overlapping the battery so that it is possible to assure a sufficient stroke for the date correcting lever 29 necessary to correct the date display as well as a sufficient space for pins or tubes for controlling or connecting the gear trains or compound circuits. Moreover, it is possible to provide uniform contact between the date dial and the guide plate thereby facilitating the operation of a calendar mechanism. In the embodiment shown in FIG. 2, the date dial and week day dial rotate in the opposite direction, but it is possible to make them to rotate in the same direction by interposing an intermediate gear between the cylindrical gear 33 and the display feed gear mechanism 50.

What is claimed is:

1. An electronic watch comprising a base plate, a rear plate secured to said base plate, a battery cell secured in an aperture in said base plate, a control stem mounted on said base plate, a calendar mechanism including a calendar display correcting means and a display feed gear opposite said control stem and a control member overlapping said battery cell, said calendar display correcting means being positioned adjacent said control stem, a display guide plate mounted on said base plate through said rear plate, said display guide plate engaging said rear plate and being positioned to form with said rear plate a reinforced support for said battery cell, said display feed gear comprises a date feed pawl and a day feed pawl superposed on said date feed pawl, and said calendar display correcting means comprises a first gear pivotally mounted on said base plate in engagement with a stem gear on said control stem, a correction gear pivotally mounted on said base plate in engagement with said first gear, and a lever means for correcting the day and date displays.

2. The electronic watch of claim 1 wherein said lever means is located below said rear plate.

3. The electronic watch of claim 2 wherein said day feed pawl is actuated by a projection of said date feed pawl.

* * * * *